United States Patent [19]

Thelen et al.

[11] Patent Number: 4,564,310

[45] Date of Patent: Jan. 14, 1986

[54] RESILIENT PAVING COMPOSITION FOR PLAYFIELDS SPORTS FIELDS AND RECREATION AREAS

[76] Inventors: Edmund Thelen, 658 Davis La., Strafford; Daniel N. Black, III, 330 Gulph Hills Rd., Radnor, both of Pa. 19087; Thomas L. Kiley, 3908 Newport Gap Pike, Wilmington, Del. 19808

[21] Appl. No.: 618,495

[22] Filed: Jun. 8, 1984

[51] Int. Cl.[4] ..... E01C 5/02; E01C 5/18; E01C 5/22

[52] U.S. Cl. ..... 404/31; 404/32; 428/331

[58] Field of Search ..... 404/31, 32; 428/331

[56] References Cited

U.S. PATENT DOCUMENTS

| | | | |
|---|---|---|---|
| 4,044,179 | 8/1977 | Haas, Jr. | 428/331 |
| 4,099,943 | 7/1978 | Fischman et al. | 428/331 |
| 4,263,184 | 4/1981 | Lee et al. | 525/935 |
| 4,389,435 | 6/1983 | Haas, Jr. | 428/331 |
| 4,396,653 | 8/1983 | Tomaria | 428/331 |

*Primary Examiner*—Allan M. Lieberman
*Attorney, Agent, or Firm*—Paul & Paul

[57] ABSTRACT

A porous resilient paving system for use on well-drained soil as a playing surface is described as having (1) a soil-covering layer consisting essentially of mineral aggregate having a thickness in the range of from about 2 to about 4 inches;

(2) a layer of fibrous vulcanized rubber particles covering layer (1), said layer (2) having a thickness in the range of from about one-half to about two inches;

(3) a core composition layer covering layer (2) consisting essentially of a matrix formed from about 70 to 87 weight percent vulcanized rubber fibers bonded with from about 13 to 30 weight percent of a rubber latex selected from the group consisting of natural rubber latex and synthetic rubber latex; and (4) a topping layer covering layer (3) consisting essentially of from about 68–74 weight percent vulcanized rubber particles of from about 12–30 mesh, zinc oxide in an amount from about 1–7 weight percent and bonded with about 25 weight percent of a rubber latex.

4 Claims, No Drawings

RESILIENT PAVING COMPOSITION FOR PLAYFIELDS SPORTS FIELDS AND RECREATION AREAS

This invention relates to soft, resilient, self-draining, economical pavement compositions for use in play, sports and recreation areas such as:

a. underlayment for playground and athletic equipment, where it prevents or minimizes injuries due to falls, b. complete playgrounds where it minimizes or prevents accidental injuries due to tripping, shoving or other violent collision with the surface, and injuries to joints and muscles in feet, legs, hips, back and neck due to repeated impact during running or jumping, and c. football, soccer, baseball and other sports fields to minimize or prevent accidental or fatigue-type injuries due to tackling, falling, running, jumping, or other contacts with the surface incidental to the sports, and d. in recreation areas and around pools, where the pavement composition provides comfort and safety for sitting, laying, rolling, walking and lounging around.

Synthetic pavements for tennis courts and football fields are well known to those versed in the art. They are intended to be more durable and more-or-less similar in playing characteristics to clay tennis courts and grass football fields. Resilient synthetic surfaces for running and jogging tracks also are known and at least one type, made of wood, is claimed to be faster than cinders. The materials and designs of the track and field sports products are diverse but are typified by (1) a fabric glued on a pad which is laid on a solid asphalt concrete or cement concrete base, or (2) polymer-bonded rubber particles formed in panels and mounted on a solid base.

In the former (1), the fabric contains nylon or polypropylene tufts anchored into a web by polyurethane adhesive. This is glued to a closed cell polyethylene or other pad which has been fitted to and glued to asphalt concrete paving. The cost of the materials and the elaborate construction make this pavement too expensive for widespread economical use. Furthermore, due to loss of tufts and collapse of the pad under concentrated use, as well as the lack of a suitable method for replacing the worn areas, this pavement requires replacement in as little as five years.

These earlier pavements compared to natural grass surfaces are hard, providing a more damaging impact when fallen on, and a livelier bounce to a baseball. They permit a player to slide for some distance when tackled in football, which reduces the force of his fall; whereas, in games like soccer a non-skid surface would be more appropriate and safer. Their lack of adequate cushioning, resulting in unnecessary or unduly severe injuries, is a serious deficiency in amateur or school sports and an expensive one in professional sports where large sums of money are involved. The latter (2) materials consist of semi-rigid tough blocks of polymer such as polyurethane filled with rubber particles of various shapes and sizes. These products are expensive and although they vary in resiliency in general they are deficient in this property and hence inadequate in safety and comfort.

Moreover, sand, tanbark, sawdust and wood chips are sometimes used in play and athletic areas, under acting bars and swings and in jump pits, for example. Maintenance or replacement of these materials is required frequently, as the materials wash or are kicked away. Furthermore, the materials tend to get dirty and to cling to the clothes of the players.

SUMMARY OF THE INVENTION

In accordance with this invention, there is provided a resilient paving composition which possesses a degree of softness and energy-of-impact absorption, the degree being selected to assure maximum safety or comfort of persons engaging in sport or at play. A primary goal is to reduce the injuries of children and sports people incident upon their recreational and athletic endeavors, and to reduce fatique and joint deterioration in joggers, walkers, and standing workers.

It is an object of this invention to provide such a composition with a surface which is non-skid wet and dry, and which will normally not burn or abrade the skin.

It is an additional object to provide such a composition as a porous pavement through which precipitation will pass into the underlying agregate or soil, so the play area will be free of standing water and may be built dead level.

It is a further object of the invention to provide a low cost paving material whose major component by weight consists of scrap rubber, such as from tires.

It is still a further object to provide paving which is durable in outdoor exposure, and under hard use, but which nevertheless is readily patched if any area needs replacement or repair.

The compositions of our invention are especially useful in paving systems which include, as a minimum, the pavement composition itself, or core; the base it is laid over; and the topping which is spread over the core. These and additional and alternate elements are set forth herewith.

The base for the pavement compositions of our invention typically is a layer of mineral aggregate 2 to 4 inches thick, spread over a draining soil which may or may not be covered with filter cloth. The soil may be permeable enough to drain itself, or it may contain pipes, french wells or other features.

While a cement, concrete or asphalt concrete base may be used if it is properly drained and if the soil under it is well drained and stable, this kind of base is expensive and unnecessary. The fact that in the use of the compositions of our invention such bases are neither required nor desired distinguishes our system from all other resilient pavement systems known to us.

The preferred aggregate base consists of crushed stone in the size range of $\frac{1}{4}$ to $\frac{1}{2}$ inch. This may be used throughout the aggregate base, or better, as a choke layer on top of coarser stone such as 1 inch to 2 inch material.

The aggregates are open-graded, i.e., the stones in any one layer are all about the same size. Hence, about 40% of the aggregate volume consists of voids; these serve as reservoirs to store the water percolating through the pavement until it can percolate into the soil underneath.

In accordance with one embodiment of our invention, a layer of coarse vulcanized rubber fibers is laid over the aggregate base or soil and covered with the core composition. We have found that for this purpose rubber particles shredded from tires, particularly the fibrous buffings retained on a 4 to 8 mesh screen, in a layer $\frac{1}{2}$ to 2 inches thick, contribute significant resilience to the system and thereby permit the use of thinner core compositions. A one-inch layer of fibers under a one-inch core gives the same deceleration on impact, "Gs," as a two-inch core composition alone, at a much lower cost.

The use of wood chips, tanbark, sand and other particulates under playground equipment provides a mud-free surface that is easily sheared, but does not provide much of a cushion for impacts normal to the surface. On the other hand, rubber fibers covered with the core compositions of the invention are not easily displaced in shear, and are quite compressible, hence shock-absorbing under normal impacts.

The core compositions of our invention consists of a lattice, or matrix of vulcanized rubber fibers buffed or abraded from used tires into a fibrous configuration, and bonded with rubber deposited from a natural rubber or synthetic rubber latex, such as chloroprene latex. We have found that from 14–30% of a latex containing 45–60% rubber solids may be used effectively.

Since our core composition is soft and porous, the vulcanized rubber particles should be fibrous in shape (length at least six times the diameter) and relatively course, such as minus 2 plus 16 mesh.

Powdered minerals, or fillers, are not used in the compositions of our invention because they increase the amount of latex needed, and reduce softness and porosity. The additions of small amounts of zinc oxide or other latex modifiers, however, is permitted. Likewise, coal tar and asphalt emulsions and cutbacks are compatible and may be added in small quantities to extend the latex. Asphalt may not replace substantial amounts of latex because it is absorbed into the vulcanized rubber particles causing it to lose its binding properties.

Our core composition is softer and more porous than any other resilient pavement known to us, due to the size and shape of the rubber particles and the relative amounts of latex and vulcanized rubber particles in the matrix.

The core composition of this invention has been applied as thin as ½ inch over rubber chips, and as thick as 2 inches when G impact values below 200 G on a 10-foot drop are wanted. The core composition is not self-leveling, but after mixing on the site, is spread with rakes and screeded to smooth it.

The preferred latex used in the compositions of our invention is halogenated, such as chloroprene latex, so as to be self-extinguishing when ignited.

While the core composition of this invention hardens by air drying of the latex binder, especially when applied in thick layers, it hardens slowly and there is danger of rain damage. To avoid this we prefer to use a latex containing an anionic emulsifier and after the pavement is screeded, we apply an aqueous solution containing 4% of calcium chloride at the rate of ½ to 1½quarts per square foot. The strength of the solution is sufficient to coagulate the latex in situ rather than to wash it out.

The 4% solution of calcium chloride renders ineffective the anionic emulsifier in the latex, and thereby causes it to precipitate its water immediately and allows the core composition to harden in a few minutes. 2%–6% calcium chloride solutions and other soluble ions that form insoluble salts with the emulsifier may be used as well. Hardening the pavement composition in this fashion eliminates any need for dispersing portland cement with an enteric coating in the latex.

To improve the abrasion resistance, toughness and texture of the core composition, it is preferably covered with a ⅛ inch to ¼ inch layer of a topping containing small rubber particles, a greater percent of latex, and zinc oxide in the following proportions:

| | Percent by weight |
|---|---|
| Rubber fibers - 12 + 30 mesh | 68–74% |
| ZnO | 1–7 |
| Latex (anionic) | 25 |

Pigments which do not react with the latex, generally in amounts of 1–4 percent may be added to this formula to provide colors.

These toppings are spread over the core with a trowel, and can be hardened at once with calcium chloride solution. Abrasion-resistant coatings with latex bases have been described including some containing −20 mesh rubber particles and some made by diluting acrylic latex paints with rubber latex, but these are not sufficiently permeable to water for our use. In lieu of the toppings above, the core may be covered with carpet, linoleum, artificial turf, etc. which are glued to it with urethane glue, linoleum cements, etc. Such coverings, however, not only are more expensive than our toppings, but also are themselves impermeable to water or are rendered impermeable by the glue. To use them in our porous system, it is necessary to drill holes through them after they have been installed. Three-sixteenths or quarter-inch holes 4 to 8 inches apart normally are adequate for drainage.

The softness of the pavement system arises from the viscoelastic nature of the solid phase of the core composition and the extensive volume of its void. The solid phase of the core typically consists of about 88% vulcanized rubber fibers and 12% softer rubber from the latex; the void volume, which is open and filled with air and water vapor, comprises about 55% of the total volume of the core.

Being viscoelastic, the core composition structure resists deformation both by storing energy elastically, like a steel spring, and viscously, like slowly flowing molasses. The viscoelastic characteristics of a typical core were determined by dropping a 20-lb. weight with a 20 square inch flat impact surface onto it from a height of 10 feet:

Time of impact 0.0284 sec.

Loss angle—2°39′

Storage modules (elastic) $7.28 \times 10^6$ dynes/cm$^2$ or 105.6 psi

Loss modules (viscous) $0.355 \times 10^6$ dynes/cm$^2$ or 4.9 psi

Viscous coefficient 1510 poises

Over 95% of the stiffness of the product is elastic in nature. After the product has cured for a few days, it almost totally recovers its shape after being deformed and released.

The viscous contribution to stiffness imparts a time dependence. When a load is applied for only about a hundredth of a second, the material does not deform as much and hence is stiffer than when the same load is applied for seconds or minutes. Similarly, under creep conditions, the sample continues to deform, but at a continually decreasing rate, for up to a few days, depending on the formulation.

Another consequence of the predominantly elastic nature is that the stiffness of the sample is relatively little affected by the temperature from 32° to 140°F., particularly under impact conditions.

Because of its strong, tough solid matrix and its high void volume, the product has two additional beneficial characteristics:

a. Under low compressive loads it is very soft, but as the loads increase and air is squeezed out it becomes denser and stiffer. Thus the same material can cushion a full range of loads, and b. Particularly when the area of loading is small the energy is distributed and absorbed over a much larger area. For example, the dimple created by pushing a 2-inch diameter disk into the surface may be 5–6 inches in diameter. This considerably increases the load-carrying capacity of the pavement.

The paving systems and compositions of our invention provide an economical, low-maintenance, long-lived pavement for outdoor use over virtually any sub-base which is permeable to water or otherwise drained. These pavements are porous, so as to dry fast without puddles, and soft and resilient, to minimize injuries and fatigue and to enhance comfort on playgrounds, sports fields, recreation and play areas.

Certain properties of the core compositions of this invention are as follows:

Impact

To minimize injuries in play and sports activities, the G's deceleration on impact must be minimized. A typical pavement of our invention, 2 inches thick, in ASTM Test F355, yields G values of 170 for a 10-foot drop and about 48 for a 2-foot drop.

Softness

For comfort and cushioning, the pavement must deform (compress) under loads. Depending on the formulation, a 2-inch diameter disk under 30 lbs. load will depress the pavement composition by 0.05 to 0.5 inches; the former is appropriate for sports fields and the latter for children's playgrounds.

This deformation is 90% recovered in 5 minutes, and virtually totally recovered in 24 hours.

Under greater pressures, more air is squeezed out of the material, and it becomes much stiffer.

Ball Bounce

In sports fields on which baseball is played, the height of bounce of a baseball should approximate that of natural earth. The pavement compositions of this invention meet this requirement.

Friction and Skidding

Coefficients of friction, both starting and running, both wet and dry, exceed 1.0, assuring no skidding.

Non-Snagging

Unlike pavements covered with long-pile carpets, the pavement compositions of this invention cannot snag a player's cleats and hence do not cause knee or hip injuries.

Porosity

Rate of percolation of water through the pavement composition of this invention exceeds 24 inches of rain per hour (1 quart per square foot per minute). Thus the pavement dries rapidly and without puddles, and neither drains and catchbasin nor squeegees or vacuum devices are necessary.

Solvent Resistance

Gasoline and other volatile solvents when spilled on the pavement will evaporate without causing damage. On long-time exposure, they may cause some swelling, but not any dissolving; such swelling is reversible.

DETAILED DESCRIPTION

The following examples represent detailed descriptions of the several embodiments of our invention:

EXAMPLE 1

This pavement system was installed on the ground under two swings used by preschoolers. The area, 7×8 feet, was enclosed in a wooden border. Soil was removed and 3 inches of ¾-inch gravel was tamped in. Over this was placed a one-inch thick layer of vulcanized rubber fibers (larger than 8 mesh). A mixture was then made of 80 parts of vulcanized rubber particles abraded from used tires having a fibrous shape (length six time diameter) and having a −8+16 mesh size, with 20 parts of synthetic latex (Dupont No. 115). This mixture was screeded over the layer of vulcanized rubber fibers, and finally a ¼ -inch layer of a topping (made by diluting a green acrylic latex paint with synthetic latex and mixing into this four times its weight of 10–30 mesh ground rubber particles (Baker Rubber WTP) was applied. The system was allowed to air dry. After it was completely hardened, a 30-lb. load applied on a 2-inch diameter disk depressed the pavement about 0.4 inches.

EXAMPLE 2

An 800-square foot area was enclosed in a concrete curb and a draining base of pea gravel was first laid. A core composition was made by thoroughly mixing in a 4 cu. ft. mortar mixer, 100 lbs. of −2+8 fibers from abraded vulcanized rubber tires and 25 lbs. of an anionic synthetic latex (Dupont 671 A). This mix was spread and screeded over the gravel to a depth of one and one-half inches. The surface of this layer was then sprinkled with a 4 percent solution of calcium chloride at the rate of one quart per square foot to harden it. As each patch abutted a finished patch, screeding was carried out using the finished, hardened material for one rail, and a one and one-half inch wide plank for the other. The following day, a topping was laid over this core composition to a thickness of one-half inch. The topping composition was prepared by thoroughly mixing the following ingredients:

| | Percent by weight |
|---|---|
| 8 + 16 fibers of vulcanized rubber | 66.7 |
| 16 fines of vulcanized rubber | 11.1 |
| synthetic latex (Dupont No. 671) | 22.2 |

The foregoing operations were carried out in December at temperatures below 40° F. Several weeks later after the site had dried out, a deep pile outdoor polypropylene carpet(Super Turf) was glued with a polyurethane adhesive to the topping layer. This carpet was then machine perforated to provide for drainage. The particle sizes referred to herein are based on the U.S. Sieve Series.

Having thus described our invention, we claim:

1. A paving system for well-drained soil comprising in combination 1. a soil covering layer consisting essentially of open graded mineral aggregate having a thickness in the range of from about 2 to about 4 inches;
2. a layer of fibrous scrap vulcanized rubber particles covering layer (1), said layer having a thickness in the range of from about one-half to about 2 inches;
3. a core composition layer covering layer (2), said core composition consisting essentially of from about 70 to 87 weight percent scrap vulcanized rubber fibers bonded with from about 14 to 30 weight percent of a rubber latex selected from the group consisting of natural rubber latex and synthetic rubber latex containing 45–60% rubber solids, said bonded rubber fibers comprising about 45% of the volume of said core composition, the remaining volume being void, said layer having a thickness in the range of from about one-half to about 2 inches, wherein the rubber fibers have a shape wherein the length is at least six times the diameter and have a size range of minus 2 plus 16 mesh (U.S. Sieve Series); and
4. a topping layer covering layer (3) consisting essentially of from about 68–78 weight percent vulcanized rubber particles of from about 12–30 mesh, zinc oxide in an amount from about 1–7 weight percent and bonded with about 25 weight percent of a rubber latex.

2. The paving system of claim 1, wherein the mineral aggregate of the soil covering layer is a crushed stone having a size range selected from the ranges consisting of one-quarter to one-half inch and one to two inches.

3. The paving system of claim 1, wherein the fibrous vulcanized rubber particles of layer (2) have a size range of minus 4 plus 8 mesh (U.S. Sieve Series).

4. The paving system of claim 1, wherein the rubber latex is a chloroprene latex.

* * * * *

UNITED STATES PATENT OFFICE

CERTIFICATE OF CORRECTION

Patent No. 4,564,310 Dated Jan. 14, 1986

Inventor(s) Edmund Thelen, Daniel N. Black, III & Thomas L. Kiley

It is certified that error appears in the above-identified patent and that said Letters Patent are hereby corrected as shown below:

Column 6, line 54:

"8 + 16" should read -- - 8 + 16--

Column 6, line 55:

"16" should read -- - 16--

Signed and Sealed this

Twentieth Day of May 1986

[SEAL]

Attest:

DONALD J. QUIGG

Attesting Officer

Commissioner of Patents and Trademarks